United States Patent [19]

Johnson

[11] Patent Number: 4,658,072

[45] **Date of Patent: * Apr. 14, 1987**

[54] LUBRICANT COMPOSITION

[75] Inventor: Thomas H. Johnson, Houston, Tex.

[73] Assignee: Shell Oil Company, Houston, Tex.

[ * ] Notice: The portion of the term of this patent subsequent to Jul. 31, 2001 has been disclaimed.

[21] Appl. No.: 643,124

[22] Filed: Aug. 22, 1984

[51] Int. Cl.[4] ..... C07C 13/00; C07C 2/70

[52] U.S. Cl. ..... 585/24; 585/462; 585/463

[58] Field of Search ..... 585/24, 462, 463

[56] References Cited

U.S. PATENT DOCUMENTS 4,463,207 7/1984 Johnson ..... 585/462

*Primary Examiner*—Curtis R. Davis

[57] ABSTRACT

A lubricant composition having an improved viscosity index and flash point is prepared by reacting diisopropylbenzenes and hexylbenzenes with alpha olefins using a tantalum (V) halide/oxide-gel oxide catalyst.

12 Claims, No Drawings

LUBRICANT COMPOSITION

FIELD OF THE INVENTION

This invention relates to improved alkylaromatic lubricant compositions having improved viscosity indexes and flash points.

BACKGROUND OF THE INVENTION

Heavy ends from cumene production via $H_3PO_4$/-Kieselguhr catalysts consists mainly of diisopropylbenzenes and hexylbenzenes. This by-product has a relatively low economic value. Alkylation of these by-products with olefins using a tantalum (V) halide/oxide-inorganic oxide catalyst produces a lubricant composition having a higher viscosity index and a higher flash point than conventionally alkylated similar materials.

In copending application Ser. No. 527,535, filed Aug. 29, 1983, now U.S. Pat. No. 4,489,171, the tantalum (V) halide/oxide-inorganic oxide catalyst used to prepare the compositions of the instant invention is described. In copending application Ser. No. 535,103 filed Sept. 23, 1983, now U.S. Pat. No. 4,463,207, a general alkylation process is described utilizing a tantalum (V) halide/oxide-inorganic oxide catalyst.

SUMMARY OF THE INVENTION

This invention relates to novel alkylaromatic lubricant compositions having higher flash points and viscosity indexes. They are prepared by reacting diisopropylbenzene and/or hexylbenzene with an olefin using a tantalum (V) halide/oxide-inorganic oxide catalyst.

DESCRIPTION OF THE PREFERRED EMBODIMENT

In this invention, the heavy ends by-products of cumene production, which comprise diisopropylbenzenes and hexylbenzenes are upgraded by alpha olefin alkylation using a tantalum (V) halide/oxide-inorganic oxide catalyst. These materials have higher flash points and higher viscosity indexes than materials alkylated with conventional alkylation catalysts.

As used herein, the term viscosity index ("VI") refers to the sensitivity of the lubricant's viscosity with temperature and is determined by the method described in ASTM D-2270-79. "Flash point" refers to an indirect measure of low boiling volatiles and is determined by the method described in ASTM D-92.

The key to producing the compositions of the instant invention resides in the use of the tantalum (V) halide-/oxide-inorganic oxide catalyst. The resultant compositions are a complex mixture of diisopropyl and hexylbenzenes substituted at various positions along the alkyl chain of the alkylating olefin, although there is present a higher 2-arylalkane substitution. The exact chemical make-up of the instant compositions are difficult if not impossible, to determine with conventional analytical techniques.

The catalysts used to prepare the composition of the instant invention comprise pentavalent tantalum (also written as tantalum (V)), halogen (or halide), oxygen (or oxide) and a solid inorganic oxide substrate wherein at least one valence of tantalum is bound to oxygen, which oxygen is bound to the substrate, at least one valence of the tantalum is bound to halogen and the remaining tantalum valences are bound to halogen and-/or oxygen, which oxygen may or may not be bound to the substrate. The halogens are fluorine, chlorine, bromine, iodine and mixtures thereof. Preferred halogens are fluorine and chlorine.

The inorganic oxides that are useful as substrates to prepare the catalyst are those inorganic oxides which have hydroxyl groups attached to the surface of the substrate. The hydroxyl groups provide the means by which the tantalum pentahalides are bound by reaction to the surface of the substrate. The scope of the invention is broad and any metal or semi-metal oxides which have surface hydroxyl (or oxyhydroxyl) groups can be utilized in preparing the catalysts.

The term "inorganic oxide", although used herein in the singular tense, is meant to include the single oxides such as silica, or alumina as well as plural and complex oxides such as silica-alumina. Silicaalumina-thoria, zeolites and clays. The term "semi-metal" is a term referring to the semi-conductor materials like silicon, germanium etc., although in the catalyst art, the semi-metal oxides are frequently encompassed within the term "metal oxide".

The preferred inorganic oxide substrates used to prepare the catalysts are the porous solid inorganic oxides which contain surface hydroxyl groups and which are conventionally used as catalysts and catalyst supports. Non-limiting examples of these types of materials include those having a major component of silica or alumina or both, such as, for example alumina and aluminous materials, silica and siliceous materials; clays, particularly open lattice clays; and crystalline aluminosilicates (zeolites). Non-limiting examples of aluminous and siliceous materials include, for example, silica-alumina, silica-magnesia, silica-zirconia, silica-titania, alumina-chromia, aluminaferric oxide, alumina-titania as well as ternary compositions such as, for example, silica-alumina-titania, silica-alumina-zirconia, etc. Non-limiting examples of crystalline aluminosilicates useful as substrates include synthetic zeolites such as, for example, A, X, Y, L and ZSM types such as ZSM-5 and others and naturally occurring zeolites, such as erionite, faujasite, mordenite, sodalite, cancrinite and others. Non-limiting examples of open lattice clays useful as substrates include bentonite, montmorillonite and others. In a preferred embodiment, the metal oxide should have a major component of silica or alumina or both.

Particularly suitable as substrates for preparing the catalysts are those solid inorganic oxide compositions known as metal or semi-metal oxide gels or gel oxides. The gel oxides which are particularly suitable for use in preparing the catalysts are any of the oxide gels that are well known in the catalytic art useful as either catalyst base materials or as promoting materials in catalyst compositions. Additionally, the term "metal or semi-metal oxide gel" or "gel oxide" as used herein shall also include the plural oxide gels, i.e., those that contain mixtures or compounds of two or more metal oxides. A metal or semi-metal oxide gel is basically a metal or semi-metal oxide that contains chemically bound water in the form of hydroxyl groups or oxyhydroxyl groups as opposed to adsorbed water and water of hydration, although adsorbed water and water of hydration may also be present. They are typically prepared by the precipitation of the metal or semi-metal component(s) in an aqueous medium. Upon calcination at sufficiently elevated temperatures, water is given off and the gel is converted to the oxide with two hydroxyl moieties giving one molecule of water and an oxygen is attached to a metal ion. Illustrative of gel oxide base materials used to prepare the catalysts are aluminas, silicas, alumina-silicas, alumina-zirconias, silica-zirconias and the like, including naturally occurring hydrous oxide materials such as clays, such as, for example, the kaolinites, the montmorillonites and the like. Among the clays the open lattice clays are particularly desirable. Also included are the zeolites, both natural and synthetic. The structure of the gel oxides can range from amorphous to highly crystalline. Preferred oxide gel materials are selected from the group consisting of alumina, silica, alumina-silica, crystalline aluminosilicates (zeolites) and open lattice clays.

Since the tantalum (V) halide/oxide is bound to the surface of the inorganic oxide substrate by a reaction of tantalum pentahalide with the inorganic oxide substrate through a hydroxyl moiety, the inorganic oxide substrate must have pendant surface hydroxyl groups attached to the surface. Before reaction, the inorganic oxide substrate must have pendant surface hydroxyl groups, whereas, after reaction, the inorganic oxide substrate may or may not have surface hydroxyl groups, depending on the degree of reaction with the tantalum pentahalide.

Prior to use in preparing the catalysts the hydroxyl-containing inorganic oxide substrate should be substantially free of absorbed water, i.e., "substantially dehydrated or anhydrous". The absorbed or free water is removed by heating the substrate at temperatures ranging from about 100° C. to about 900° C. prior to contact with the tantalum pentahalide vapor. Any environment that provides for drying is suitable such as air, vacuum, inert gas such as nitrogen, etc. The dried metal oxide substrate should be kept away from a humid atmosphere after drying. It is understood that a dried inorganic oxide substrate prior to use in preparing the catalysts will still contain chemically bound water in the form of hydroxide and oxyhydroxide.

An aluminum oxide gel is one of the preferred substrates. This alumina can be any of the variety of available aluminas. These are commercially available under various names such as alumina gels, activated aluminas, gamma aluminas, etc. Regarding purity of the alumina, it may be stated that small amounts of impurities are not generally detrimental, and may be beneficial when the impurity is present as a cogel. In fact "impurities" may be purposely added for catalytic effects. The following table lists several commercial aluminas and their properties which are found suitable.

| Alumina | Surface Area, $m^2g$ | Pore Vol., cc/gm | Na, ppm | $SO_4^=$, % wt | $Fe_2O_3$ % wt | $Cl^-$, % wt |
|---|---|---|---|---|---|---|
| CCI[a] | 252 | 0.8 | 160 | 0.06 | — | 0.02 |
| KA-201[b] | 365 | 0.42 | 600 | 0.03 | — | 0.01 |
| RA-1[c] | 263 | 0.26 | 4700 | 0.02 | 0.18 | — |
| ACCO[d] | 225 | 0.68 | 580 | 0.6 | — | 0.6 |
| Norton | 218 | 0.62 | 51 | 0.03 | — | 0.03 |

[a]Catalysts & Chemicals, Inc., now United Catalysts
[b]Kaiser
[c]Reynolds Corp.
[d]American Cyanamid Corp.

Silica gel is also another preferred substrate. These are readily available commercially and are essentially substantially dehydrated amorphous silica. These materials are available in various density grades, from low density with surface areas ranging from about 100–300 $m^2/g$ to regular density with surface areas up to about 800 $m^2/g$. The commercially available materials are used as dessicants, selective absorbents, catalysts and catalyst supports. Regarding purity of the silica, it may be stated that small amounts of impurities are not generally detrimental and may be beneficial when the impurity is present as a co-gel. In fact, "impurities" may be purposely added for catalytic effects. The following table lists several commercial silicas and their properties which are found suitable.

| Support | Surface Area, $m^2/g$ | Pore Vol, cc/g | Density g/cc | Particle Size |
|---|---|---|---|---|
| Davison* Grade 952 $SiO_2$ | 300 | 1.65 | 0.35 | 70 mesh (avg) |
| Davison Grade 59 $SiO_2$ | 300 | 1.15 | 0.38 | 8 mesh |
| Davison Grade 57 $SiO_2$ | 300 | 1.0 | 0.4 | 100 mesh |
| Davison Grade 12 $SiO_2$ | 700 | 0.54 | 0.75 | 20 mesh |
| Davison Grade 03 $SiO_2$ | 750 | 0.43 | 0.7 | 8 mesh (avg) |

*Manufactured by Davison Chemical Div., W. R. Grace & Co.

Other preferred substrates are the aluminosilicates. These materials contain various mixtures of aluminum and silicon oxides. They are readily available commercially and are generally employed as cracking catalysts. Typically they contain from about 50 to about 95, preferably from about 70 to about 90 percent by weight of silica. Illustrations of commercially available alumina-silicas are Davison Grade 980-25 (manufactured by Davison Chemical Division, W. R. Grace & Co.) which contains about 75% $SiO_2$ and 25% $Al_2O_3$ and Davison Grade 980-13 which contains about 87% $SiO_2$ and 13% $Al_2O_3$. These materials can be prepared in a conventional fashion, as for example by co-precipitation, co-gellation, or by spray drying.

Encompassed within the term "aluminosilicates" are most of the zeolites.

The zeolites are found to be specifically useful as substrates. Zeolites are ordered, porous crystalline aluminosilicates having a definite crystalline structure within which there are a large number of small cavities which are interconnected by a number of still smaller channels. Zeolites useful as substrates may be either synthetic or natural. At least 34 species of zeolite minerals are known and the synthetic zeolites number in the hundreds. Any zeolite will be useful as a substrate provided that the zeolite, prior to reaction with tantalum pentahalide, contains chemically bound water in the form of hydroxyl groups. Depending on the state of reaction, the reacted product may contain no hydroxyl groups, if all such groups were reacted with the tantalum pentahalide, or there may be unreacted hydroxyl groups still present.

The techniques for the preparation of the tantalum pentahalide intermediates are well known in the art and typically are prepared by passing a dry halogen gas over tantalum metal at elevated temperatures. By way of illustration, tantalum pentachloride is prepared by passing dry chlorine over tantalum metal at a temperature above 200° C. The tantalum pentahalides utilized will comprise tantalum pentafluoride, tantalum pentachloride, tantalum pentabromide and tantalum pentaiodide.

The gal oxide-tantalum (V) halide/oxide catalysts are prepared by a process comprising reacting under substantially anhydrous and oxygen-free conditions a suitable gel oxide which has water chemically bound as hydroxyl and which is substantially free from absorbed water with tantalum pentahalide vapor and thereafter recovering the product. The metal or semi-metal oxide catalysts thus produced have tantalum (V) halide/oxide bound to the surface thereof. By the term "bound" it is meant herein that the pentavalent tantalum has at least one valence bound to an oxygen which is part of the inorganic oxide substrate. By the term "surface" it is meant both the external and internal pore surfaces which are accessible to the tantalum pentahalide vapor during the prepartive process.

The tantalum pentahalides readily sublime and thus lend themselves to a preferred method of prepared which is called "reactive sublimation" wherein tantalum pentahalide is sublimed into an anhydrous, non-oxidizing atmosphere and allowed to contact and react with the hydroxyl-containing metal or semi-metal oxide.

In the preparation of the catalysts, by reactive sublimation, it is important that the reaction be carried out under substantially anhydrous conditions and in a neutral or reducing environment to prevent decomposition of the tantalum halide.

In this preferred method of catalyst preparation, the tantalum pentahalide is sublimed by suitable application of temperature and/or vacuum into an essentially anhydrous and oxygen-free atmosphere where it is allowed to contact and react with a substantially anhydrous, hydroxyl-containing metal or semi-metal oxide substrate. Any temperature and/or vacuum which causes the tantalum pentahalide to sublime is suitable. Temperatures up to about 200° C. are suitable. Frequently the inorganic oxide substrate is heated during the reaction, say up to about 200° C. This heating is not critical to the preparation of catalysts, but it has been found that by so heating, a more even distribution of the tantalum pentahalide on the metal oxide subtrate is effected. After reaction, the inorganic oxide composition is frequently subjected to an additional period of time at sublimation conditions without the presence of a tantalum pentahalide source. This extra step allows for any unreacted tantalum pentahalide to be sublimed off of the metal or semi-metal oxide composition. The inorganic oxide substrate before use is frequently subjected to a heat treatment to remove absorbed water. Vacuum can also be applied. Generally, if the pretreatment temperature is too low, free water will remain, and, if the temperature is too high, sintering of the inorganic oxide substrate will occur, both of which can adversely affect the catalytic properties. Generally, the most desirable pretreatment temperatures of the metal oxide substrate range from about 200° to about 400° C.

It is postulated that when tantalum pentahalide reacts with the hydroxyl group of a inorganic oxide substrate, that the reaction may be illustrated variously as follows (using chloride as an illustrative halide):

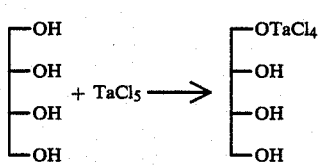

I

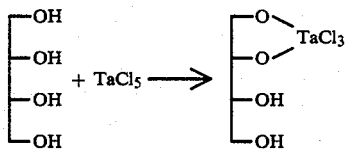

II

-continued

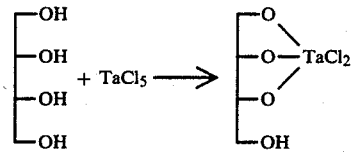

III

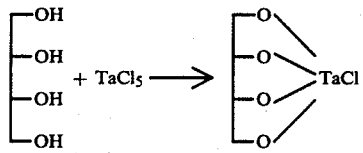

IV

In the final catalyst a mixture of the above described reaction products will exist. The distribution of these reaction products is believed to be affected by reaction conditions, such as temperature. Analysis of chlorine/tantalum ratios in catalysts containing about 8–17% wt. of tantalum show Cl/Ta atomic ratios of from about 2.5:1 to about 3.5 to 1.

Thus, depending on the tantalum content desired in the final catalyst, a tantalum pentahalide vapor is reacted with the hydroxyl-containing metal or semi-metal oxide substrate until a part or the whole of the hydroxyl group population of the metal oxide substrate is exhausted.

The reaction between the tantalum pentahalide vapor and the hydroxyl-containing inorganic oxide substrate is carried out at temperatures ranging from about room temperature to elevated temperatures, say to 150°–200° C. or higher. The reaction is normally carried out in an anhydrous, i.e., free from water vapor, atmosphere. The atmosphere should further be a neutral or reducing atmosphere i.e., oxygen-free. Dispersal of the tantalum pentahalide vapor in a vacuum provides a quite suitable atmosphere for reaction with the metal or semi-metal oxide substrate.

The inorganic oxide-tantalum (V) halide/oxide catalysts may be produced in virtually any physical form, as for example, they may be pellets, beads, extrudates, microspheres and in other particular forms, as for example rings, saddles and the like and in porous or non-porous form.

The catalysts basically comprise metal or semi-metal oxide substrates having tantalum (V) halides/oxides reactively bound to the surface of said substrate. The halides are selected from the group consisting of fluoride, chloride, bromide, iodide and mixtures thereof. Preferred halides are fluoride and chloride. The catalysts are generally prepared by a process which comprises contacting the hydroxyl-containing metal or semi-metal oxide substrate in a substantially anhydrous state with tantalum pentahalide in the vapor state and allowing the vapor to react with the substrate in an atmosphere which is substantially oxygen- and water-free. In the preferred process sublimation of the tantalum pentahalide is used to put the tantalum pentahalide in the vapor state. Tantalum pentachloride is the preferred sublimation agent, producing the highest metal loadings on the inorganic oxide substrate.

A variation of the above process is utilized to product a catalyst containing mixed halides, particular mixed chlorides and fluorides. In this variation a tantalum (V) chloride/oxide-inorganic oxide composition is prepared by reactive sublimation. The tantalum (V) chloride/oxide-metal oxide composition is then contacted with an oxygen-containing gas or a chemical compound containing oxygen which is weakly covalently bonded to the compound. It is postulated that oxygen replaces part of the halide of the composition. The material is then reacted with a liquid or gaseous fluorinated hydrocarbon which is believed to react preferentially with the oxygen bound only to the tantalum, producing, it is postulated, a composition containing various mixtures of chlorides, fluorides, oxides, oxychlorides, oxyfluorides, oxychlorofluorides, etc., depending on reaction conditions. Analyses of catalysts prepared in this fashion show that they contain varying amounts of chlorine and fluorine along with amounts of oxygen (not bound to the substrate) ranging from insignificant to moderate, depending on the degree of fluorination obtained using the fluorinated hydrocarbon. The amount of oxygen remaining can be varied by choice of fluorinated hydrocarbon and reaction conditions. Reaction temperatures and pressures for the reaction with the fluorinated hydrocarbon are not critical. Temperatures of room temperature or greater are generally suitable. Different fluorinated hydrocarbons will have different optimum temperatures, pressures and times of contact, and these can readily be determined by routine experimentation. Particularly suitable fluorinated hydrocarbons are the Freons, such as, for example Freon 12 ($CF_2Cl_2$), Freon 14 ($CF_4$), Freon 23 ($CHF_3$), Freon 112 ($CCl_2F$-$CCl_2F$), Freon 116 ($CF_3$-$CF_3$), Freon 142 (chlor-difluor-methyl methane), Freon Cl38 (octafluorocyclobutane) and similar materials. One particular advantage of this process is that it allows for the preparation of catalysts containing higher amounts of fluoride than does the process using reactive sublimation of tantalum pentafluoride alone. Compositions containing the fluoride are more resistant to oxygen degradation than the compositions containing chloride alone. Thus, when the mixed chloride/fluoride compositions are used as catalysts, the feeds need not be purged of oxygen and air is no longer a poison. Feeds containing oxygen (e.g., $O_2$, peroxide, etc.), however, will still compete for catalyst sites and, hence, the observed rates of reaction can be reduced.

As noted above, a modification of the basic catalyst can be obtained by contacting the tantalum (V) halide/oxide inorganic oxide compositions with oxygen or a compound containing oxygen which is weakly covalently bonded to said compound. Illustrative of said compounds are the peroxides and peroxy compounds, both organic and inorganic, the hypohalide's etc. It is postulated that contact of the catalysts with oxygen or the indicated oxygen-containing compounds converts part of the halogen on the composition to oxygen which is not bound to the substrate. Thus, there are two possible types of oxygen bound to the pentavalent tantalum of the composition. One type is the oxygen(s) which is bound to the tantalum and to the substrate. This presence of this type of oxygen is required to produce the catalysts. The other type of oxygen which optionally may be present is oxygen bound only to the tantalum of the catalyst composition. Thus, at least one valence of pentavalent tantalum is bound to oxygen which is bound to the substrate, at least one valence of the tantalum is bound to halogen and the remaining tantalum valences are bound to halogen and/or oxygen which is or is not bound to the substrate. This modification containing the optional oxygen may be effected either inadvertantly or purposefully. It may be effected by contact with oxygen or oxygen-containing compounds present as additives or impuritie in feed streams when the compositions are used as catalysts.

One of the feed stocks used to prepare the lubricant compositions of the instant invention comprises a mixture of diisopropyl- and/or henylbenzenes. These are basically the heavy ends from cumene production via $H_3PO_4$/Kieselguhr catalyst. This bottoms stream may be subjected to minor certain purification steps, such as flash distillation. A typical "bottoms" material from cumene production which has been distilled (IBP-225° C.) to reduce black colored bodies has the following composition:

35% hexylbenzene
49% diisopropylbenzene
8% pentylbenzene
5% t-butylbenzene
2% i-propyltoluene
1% cumene Generally, bottoms compositions which are useful feeds in this invention will have compositions of 25–50% w hexylbenzene, 35–65% w diisopropylbenzene, with the balance as other substituted benzenes.

The other feed stock used is an alpha olefin feed stock. The alpha olefins in this feed stock have carbon numbers ranging from about 8 to about 22, preferably from about 10 to about 18. This feed stock may be a mixture of alpha-olefins of differing carbon numbers or may be comprised substantially of one olefin.

The above-described aromatic reactant and olefin reactant are reacted together in the presence of the tantalum (V) halide/oxide-oxide gel catalyst described herein using conventional techniques, such as a stirred reactant or a packed bed. The reaction temperature generally ranges from about 25° to about 400° C., preferably from about 100 to about 300° C.

Pressures are not critical and generally range from about atmospheric to about 700 psi. After reaction, the lubricant product is separated by conventional means, such as fractional crystallization or distillation.

Preparation of the compositions of the instant invention are described below by the following Illustrative Embodiments which are provided for illustration, and are not to be construed as limiting the invention.

Illustrative Embodiment

Catalyst Preparation

The following illustrates a typical preparation of the catalyst used to make the lubricants of the instant invention. Other examples are given in U.S. application Ser. No. 527,535 filed Aug. 29, 1983, now U.S. Pat. No. 4,489,171 issued Dec. 18, 1984, incorporated by reference herein. In this preparative technique a glass scrubbing bottle was modified by internally adding a course fritted disc which divided the bottle into a upper section and a lower section. The lower section was fitted with a stoppered connection which allowed it to be charged with tantalum pentachloride and the upper section was fitted with a vacuum stopcock connection which allowed it either to be closed off or connected to a vacuum. To the modified gas-scrubbing bottle were added about 20 g of $TaCl_5$ to the bottom section and 60 g of Davison 57 silica (−20+30 mesh, pretreated at 300° C. under 0.1 torr vacuum for 12–24 h) to the top section. Both sections were loaded in a dry box containing a nitrogen atmosphere. The bottom section was stoppered and the top section had the vacuum stopcock closed before removing from the dry box. The bottom section of the bottle was immersed into an oil bath and heated at about 150° C. The top section was wrapped with heating tape and heated to about 150° C. A vacuum (about 0.1 torr) was applied at the top of the bottle. The heating and vacuum phase of the preparation was simultaneous and carried out over a period of 18 h. At the end of 18h, the bottle (vacuum stopcock closed) was put back into the dry box and 20 g a fresh $TaCl_5$ was added to the bottom section. The rest of the procedure was then repeated for another 18 h. Then the silica was removed, in a nitrogen-filled dry box, and vertically sublimed at 150° C. and 0.1 torr for 18h. This step was employed to remove any deposited but unreacted $TaCl_5$ on the silica surface. A small (<200 mg) of $TaCl_5$ was generally collected on the cold finger of the sublimator.

Twelve milliliters of the tantalum (V) chloride-silica composition was added to a fixed-bed flow reactor and treated with air at a flow rate of 4 l/min for 15 minutes at 100 psi and 200° C. The air-treated material was then treated with Freon 12 ($CF_2Cl_2$) at 200° C. and 70 psi at a flow rate of 2.4 l/hr for 5 hours. The flow tube was then sealed and left under an atmosphere of Freon 12 at 200° C., 75 psi for 60 hours. Analysis of the resultant composition of the instant invention by neutron activation showed it to contain about 15.7% w Ta, 1.9% w Cl and 5.7% w F.

Lubricant Preparation

A feed containing about 35% hexylbenzenes, 49% diisopropylbenzenes and 1-octadecene in a weight ratio of benzenes: 1-octadecene of 3.2:1 was fed up-flow at a liquid hourly space velocity of about 3 $h^{-1}$ through a fixed-bed reactor containing 10 cc of the catalyst prepared similar to that described about (~15% w Ta) at 200°-300° C. and 100-500 psig. The conversion of 1-octadecene was about 25% per pass. The lubricant was distilled from the product (that portion greater than 610° F. was considered lubricant). The distilled material had a VI of 105 and a kinematic viscosity of 3.9 cSt. at 100° C. This material was further distilled into two parts: Part A—44% w and Part B—56% v with the following properties:

| | Part A | Part B |
|---|---|---|
| Kinematic Viscosity @ 100° C. | 3.1 cSt | 4.7 cSt |
| Flash Point | — | 450° F. |
| Pour Point | — | −10° F. |

The above experiment was repeated using a 50—50 (w/w) mixture of meta/para-diisopropylbenzene and 1-hexadecene. The resultant lubricant had a kinematic viscosity of 3.6 cSt @100° C. and a VI of 89. For comparison purposes a similar material made with a conventional alkylation catalyst, e.g. $AlCl_3$, had a kinematic viscosity of 3.97 cSt @100° C. and a VI of 79. Thus, for this material, lubricants made by the process of this invention show a 10 VI improvement over that prepared by a conventional process.

I claim:

1. An improved alkylaromatic lubricant composition prepared by a process which comprises reacting an aromatic reactant comprising diisopropylbenzene and/or hexylbenzene with an alpha olefin reactant having an average carbon number ranging from about 8 to about 22 at a temperature ranging from about 25° to about 400° C. in the presence of a catalyst comprising pentavalent tantalum, halogen, oxygen and an inorganic oxide substrate wherein at least one valence of tantalum is bound to oxygen which is bound to the substrate, at least one valence at the tantalum is bound to halogen and the remaining tantalum valences are bound to halogen and/or oxygen which may or may not be bound to the substrate and subsequently separating the lubricant composition from the reaction mixture.

2. The composition of claim 1, where, in said catalyst, the inorganic oxide substrate is silica, alumina, silica-alumina, zeolite, open lattice clay or mixtures thereof.

3. The composition of claim 1, where, in said catalyst, the inorganic oxide substrate has a major component of silica, or alumina or a mixture thereof.

4. The composition of claim 1, 2 or 3, where, in said catalyst, the halogen is chloride, fluoride or a mixture thereof.

5. The composition of claim 1, wherein said olefin has a carbon number ranging from about 10 to about 18.

6. The composition of claim 1, wherein the temperature ranges from about 100° to about 300° C.

7. A process for preparing an improved alkylaromatic lubricant composition which comprises reacting an aromatic reactant comprising diisopropylbenzene and/or hexylbenzene with an alpha olefin reactant having an average carbon number ranging from about 8 to about 22 at a temperature ranging from about 25° to about 400° C. in the presence of a catalyst comprising pentavalent tantalum, halogen, oxygen and an inorganic oxide substrate wherein at least one valence of tantalum is bound to oxygen which is bound to the substrate, at least one valence at the tantalum is bound to halogen and the remaining tantalum valences are bound to halogen and/or oxygen which may or may not be bound to the substrate and subsequently separating the lubricant composition from the reaction mixture, and subsequently separating the lubricant composition from the reaction product.

8. The process of claim 7, where, in said catalyst, the inorganic oxide substrate is silica, alumina, silica-alumina, zeolite, open lattice clay or mixtures thereof.

9. The process of claim 7, where, in said catalyst, the inorganic oxide substrate has a major component of silica, or alumina or a mixture thereof.

10. The process of claim 7, 8 or 9, where, in said catalyst, the halogen is chloride, fluoride or a mixture thereof.

11. The process of claim 7, wherein said olefin has a carbon number ranging from about 10 to about 18.

12. The process of claim 7, wherein the temperature ranges from about 100° to about 300° C.

* * * * *